US005100369A

United States Patent [19]

Keeler

[11] Patent Number: 5,100,369

[45] Date of Patent: Mar. 31, 1992

[54] SYSTEM FOR CONTINUOUS HIGH SPEED APPLICATION OF FITMENTS TO CARTON BLANKS

[75] Inventor: Donald E. Keeler, Sussex, N.J.

[73] Assignee: International Paper Company, Purchase, N.Y.

[21] Appl. No.: 571,811

[22] Filed: Aug. 24, 1990

[51] Int. Cl.[5] ..... B31B 1/84; B31B 17/90

[52] U.S. Cl. ..... 493/87; 493/213

[58] Field of Search ..... 493/84, 85, 87, 210, 493/212, 213, 374, 379

[56] References Cited

U.S. PATENT DOCUMENTS

| | | | |
|---|---|---|---|
| 1,793,082 | 2/1931 | Goss | 93/35 R |
| 1,986,847 | 1/1935 | Pechy | 493/84 |
| 2,200,276 | 5/1940 | Hothersall et al. | 493/87 |
| 2,395,352 | 2/1946 | Staude et al. | 93/36 |
| 2,664,034 | 12/1953 | Fischer | 93/36 |
| 2,801,578 | 8/1957 | Bayley | 93/39 |
| 2,972,184 | 2/1961 | Andrew | 493/87 |
| 3,052,588 | 9/1962 | Anderson et al. | 156/252 |
| 3,381,593 | 5/1968 | Gentry | 93/37 |
| 3,400,878 | 9/1968 | Heller et al. | 493/85 |
| 3,690,223 | 9/1972 | Klausmann et al. | 93/53 R |
| 4,056,046 | 11/1977 | Hughes | 93/49 R |
| 4,194,442 | 3/1980 | Martelli | 93/53 SD |
| 4,548,668 | 10/1985 | Roth et al. | 156/357 |
| 4,604,850 | 8/1986 | Reil | 493/85 |
| 4,642,085 | 2/1987 | Helm | 493/222 |
| 4,705,197 | 11/1987 | Gordon et al. | 206/604 |
| 4,713,048 | 12/1987 | Reil et al. | 493/87 |
| 4,767,390 | 8/1988 | Herring | 493/88 |
| 4,770,325 | 9/1988 | Gordon et al. | 222/481 |
| 4,816,014 | 3/1989 | Bratton et al. | 493/88 |

FOREIGN PATENT DOCUMENTS

| | | | |
|---|---|---|---|
| 909052 | 9/1972 | Canada | 493/87 |

*Primary Examiner*—William E. Terrell

*Attorney, Agent, or Firm*—Walt Thomas Zielinski

[57] ABSTRACT

A fitment sealing apparatus employs a high-speed continuous-motion conveyor for carton blanks and a rotary sealer for sealing fitments to the carton blanks by maintaining heat and pressure contact over a given duration through a prescribed turning angle. The rotary sealer is positioned adjacent an inside corner of two portions of the conveyor arranged at a right angle, and has four heating anvils spaced circumferentially at 90 degrees to each other. An adhesive applicator applies a layer of hot-melt adhesive between the fitment and carton blank which is formed into an excellent seal by the rotary sealer. For fitments of the flat, reclosable type, the apparatus includes a secondary adhesive applicator and a plowover bar to form the fitment in its folded-over configuration.

20 Claims, 4 Drawing Sheets

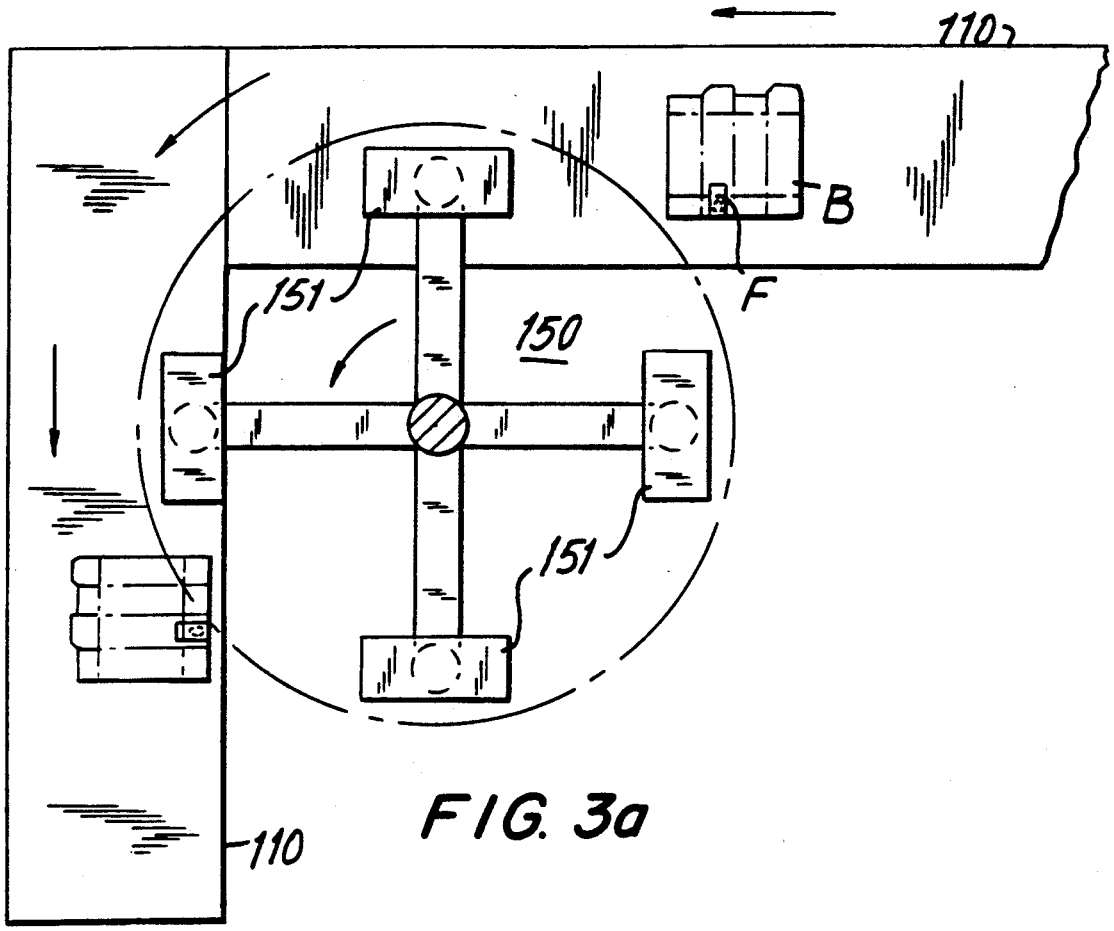
FIG. 3a
FIG. 3b
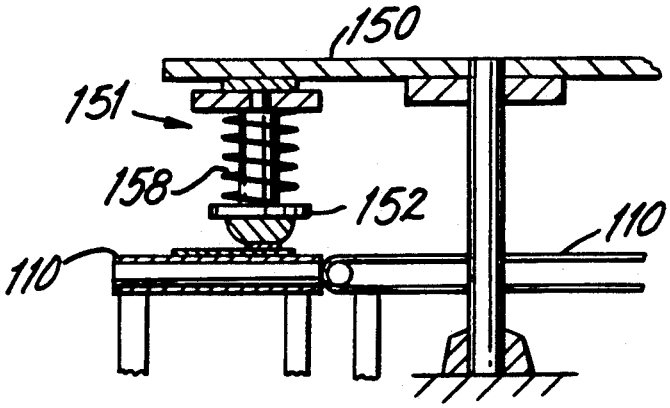

SYSTEM FOR CONTINUOUS HIGH SPEED APPLICATION OF FITMENTS TO CARTON BLANKS

FIELD OF INVENTION

This invention generally relates to an apparatus for application and sealing of spout or closure fitments to carton blanks used to form containers for milk, juice, and other liquid beverages, and, in particular, to such an apparatus which can be operated continuously at high-speed to supply fitted carton blanks for further processing through a conventional form/fill/seal machine.

BACKGROUND ART

Conventional apparatus for attachment of plastic closure fitments typically employ in-line pairs of heated rollers arranged for receiving carton blanks therebetween and applying heat and pressure to the fitment and an extrusion layer on the carton blank at a point of tangential contact between the opposed surfaces of the rollers. Sealing rollers such as these do not apply heat and pressure to the fitment and extrusion layer combination when they are not in contact therewith. The extrusion layer is made of a heat-sealable material which is intended to form a thermal bond upon application of heat and pressure. Thus, in a conventional in-line apparatus, if the fitment does not immediately engage the extrusion layer, there is a possibility that the adhesive bond between the fitment and the extrusion may be defectively formed.

Additional rollers can be employed to provide successive applications of heat and pressure to the fitment and extrusion combination to ensure that a sufficient bond is formed. However, the additional rollers add length to the line, increase the cost of line operation and maintenance, and also increase the possibility of line breakdown. Alternatively, it has been recognized that intermittent motion type machines can supply heat and pressure for longer periods of time, but these machines heretofore have not proved satisfactory because they do not accommodate continuous feeding in high speed production. In these machines, a conventional bench type sealing apparatus can be employed to achieve fitment-to-extrusion adhesion wherein a carton blank and associated fitment are removed from a conveyor and appropriate heat and pressure are applied to the combination until the desired seal or adhesion is achieved. The finished blank is then returned to the conveyor which in turn is incremented, and the process is repeated again for the next fitment and carton.

The assignee of the present invention has developed low-profile plastic pour spout fitments which may be provided in a die-cut web for application to carton blanks by heat sealing processes. Each fitment is configured to form a pour spout upon removal from the web and attachment to a carton blank. Exemplary fitment configurations within the scope of this technology can be found in U.S. Pat. Nos. 4,705,197 and 4,770,325, both to Gordon and Kalberer, the disclosures of which are incorporated herein by reference.

The assignee has also developed an indexing apparatus which effects precise registration of fitments in die-cut openings within carton blanks. An example of this apparatus is disclosed in commonly-owned U.S. Pat. Application Ser. No. 165,647, filed Mar. 8, 1988, in the names of Keeler, Bombolevich, and Sinocchi. Another example of an apparatus for the continuous application and sealing of die-cut fitments, such as plastic pour spouts, to carton blanks on a continuous conveyor line is disclosed in commonly-owned U.S. Pat. Application Ser. No. 304,990, filed Feb. 1, 1989, in the names of Keeler and Bombolevich. The disclosures of these applications are also incorporated herein by reference.

However, there remains a need in the art for a high-speed sealing apparatus capable of synchronously interfacing with a high-speed continuous conveyor line to provide efficient and reliable fitment-to-extrusion adhesion using heated members. The apparatus should be useable with conventional carton blanks and fitments to ensure direct interface with existing types of production lines and, ultimately, consumer product acceptance.

SUMMARY OF THE INVENTION

In the present invention, there is provided a line-synchronized apparatus for sealing and adhering of fitments to the extrusion layer of carton blanks through the application of heat and pressure by heated members on a continuous conveyor line over a prescribed period of time. The heating and pressure duration is obtained by means of a rotary sealer which receives and maintains contact with the fitment and carton blank through a prescribed turning angle, such as 90 degrees. The rotary sealer includes a rotary anvil which maintains contact with the fitment overlying a die cut opening in the carton blank while a compression spring actuator provides pressure sufficient to establish fitment to extrusion adhesion and seal. The rotary sealer is synchronized with the flight conveyor and engages the carton blanks on the flight conveyor at a matched speed. The rotary sealer can be positioned adjacent to an inside corner of two conveyors arranged at a right angle in order to maintain contact with the workpiece over a 90 degree turning angle.

Manufacturing efficiency requires an apparatus having a capability of achieving direct and positive adhesion and sealing of the fitment to the extrusion layer while handling the carton blanks on a continuous-motion conveyor. The invention also provides a fitment plowover bar and adhesive applicator for handling teardrop fitments in-line on the conveyor.

Other objects, features and advantages of the present invention will be apparent when the following detailed description of the preferred embodiments of the invention is considered in conjunction with the drawings, which should be construed in an illustrative and not limiting sense, as follows:

BRIEF DESCRIPTION OF THE DRAWINGS

FIG. 3*a* is a plan view of the arrangement of multiple anvil heads on the/rotary sealer;

FIG. 3*b* is a partial sectional side view of an anvil head of the rotary sealer shown in FIG. 3*a*.

DETAILED DESCRIPTION OF THE INVENTION

Figure 1:
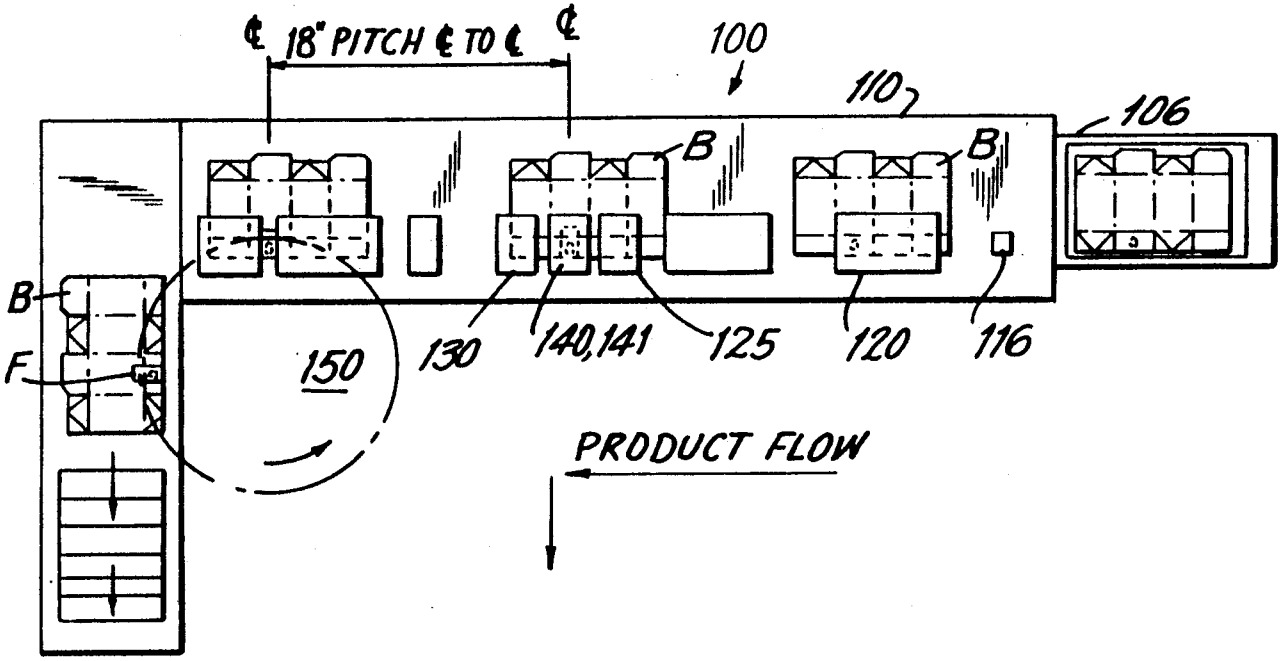
FIG. 1 is a schematic plan view of a preferred embodiment of the invention employing a rotary sealer to seal fitments to carton blanks, conveyed on a flight conveyor.
Figure 2:
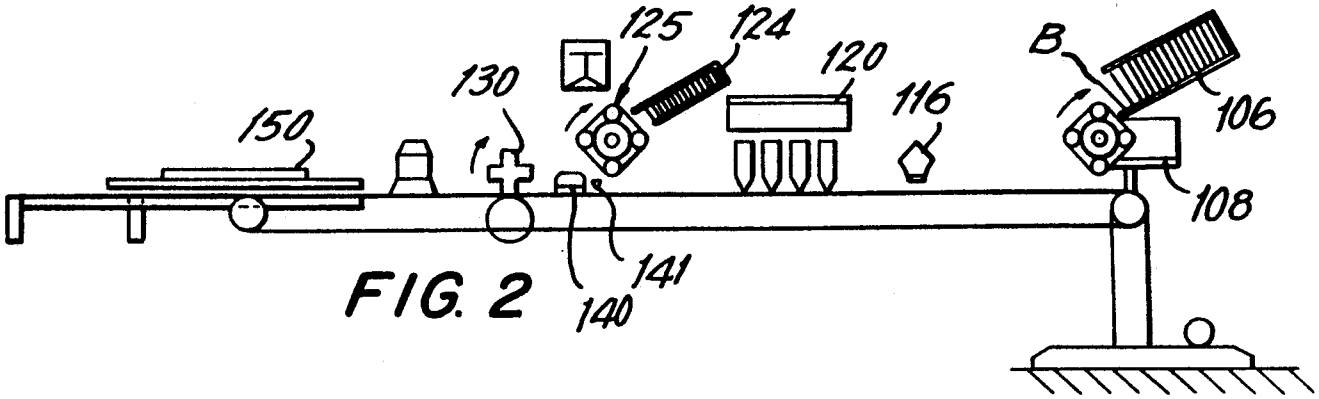
FIG. 2 is a schematic elevation view of the flight conveyor and rotary sealer apparatus shown in FIG. 1.

Referring to FIGS. 1 and 2, there is shown a preferred embodiment of a high-speed fitment application system 100 in accordance with the present invention for synchronously sealing and adhering fitments F to carton blanks B. The system 100 generally includes a carton blank supply magazine 106 from which carton blanks B are dispensed in timed sequence by a rotary pick-and-place feeder 108 onto a continuous-motion flight conveyor 110. The rotary pick-and-place feeder may be a conventional unit, available from Thiele Engineering Co.

The flight conveyor 110 is fitted with steel lugs (not shown) which capture the carton blanks B at each side (at the rear) and move the carton blanks B along with the motion of the conveyor 110 at a precise speed through the operating stations along the line path. The pick-and-place feeder 108 is designed to mechanically engage the carton blanks B from the magazine 106 and place each carton blank B onto the flight conveyor 110 between the pusher lugs spaced at a pitch of approximately 18 inches and at a rate of approximately 300/minute.

The system 100 may include a sensor 116 which detects an opening, such as the die-cut opening for the spout, in the carton blank B. For teardrop fitments, the opening has a corresponding teardrop shape and is surrounded by a fitment attachment area. A control mechanism (not shown) can supply information derived from the sensor 116 to other stations to ensure unified line operation.

The system 100 has an adhesive applicator station 120 which operates at a matched speed with the conveyor line 110 and applies a hot-melt adhesive to the fitment attachment area of the carton blank B in preparation for the subsequent receipt of the fitment F. The station 120 can employ a non-contact electric nozzle-type applicator, e.g., sold under the name Spraymation, from Spraymation Co., of Ft. Lauderdale, Fla., or a rotary contact-type applicator, e.g., under the name Acumeter, from Acumeter Laboratories of Marlborough, Mass. Either type has been selected to accurately dispense a measured amount of hot-melt adhesive in a precise desired pattern on the carton blank at a matched speed.

The continuous-motion flight conveyor 110 is designed to provide a continuous motion in excess of 200 feet/minute, and preferably about 300 feet/minute, although a flight conveyor of this type can operate up to speeds of approximately 450 feet/minute. Conveyors operating at speeds in this range allow for the automated processing of approximately 300 blanks per minute and lines operating at these speeds are generally referred to as high-speed lines.

After adhesive preparation at station 120, the carton blanks B are next supplied to a fitment pick-and-place station 125 which dispenses fitments F from a magazine 124 and delivers the fitment in a precisely aligned relation to the hot-melt-treated opening of the carton blank B being carried on the continuous motion flight conveyor 110. The magazine may be arranged to handle three-dimensional (3-D) embossed type fitments. Also, flat fitments, such as teardrop-shaped fitments which are dispensed from a die-cut web, can be handled by the system 100. The fitment pick-and-place station 125 can include an advance-cam, rotary vacuum unit which utilizes vacuum cups to pick the fitments F from the magazine and place them in the precise position over the die-cut opening in the carton blank B. One such apparatus is available from Minnesota Automation, of Crosby, Minn.

The fitment and carton blank assembly can be preprocessed through an optional pressure sealing station 130 which applies pressure between the fitment F and the carton blank B sufficient to ensure that the fitment is adhesively secured in the proper position on the blank B prior to passing through the sealing station 150. An optional radiant heater 135 may also be provided to pre-soften the hot-melt adhesive prior to entry into the sealing station 150. The radiant heater 135 can heat the adhesive to a temperature of about 79.0 to 93.3 degrees Centigrade.

After the fitment F has been fixed in position on the carton blank B, and any pre-treatments such as pressure or heat have been applied, the assembly is supplied to the sealing station 150. As shown in FIG. 3A, the sealing station is comprised of a rotary member having a plurality of heating anvils 151 angularly spaced along a circumferential portion aligned with the path of the fitment to be sealed to the carton blank B. The rotary member 150 is positioned at an inside corner of a turn from one portion of the conveyor 110 going in one direction to another portion of the conveyor continuing in a right-angle direction therefrom.

As each carton blank passes under the leading part of the rotary member, the fitment and the carton attachment area on which it is positioned become grasped between a heating anvil in timed sequence and the surface of the conveyor 110. As the circumferential speed of the rotary member is matched to the conveyor speed, the heating anvil remains in contact with the fitment/carton assembly over a turning angle of 90 degrees of the rotary member. The heating anvil can thus apply substantially uniform heat and pressure to the assembled combination during the turning duration sufficient to soften the hot-melt adhesive and form a completely reliable seal between the fitment and the extrusion layer in the carton attachment area.

In FIGS. 3A and 3B, the rotary sealer 150 has four thermoelectrically powered heating anvils 151. The carton blanks B can therefore be handled continuously and at high speed without having to remove the blanks B from the flight conveyor 110. The heating head 152 of each anvil 151 applies the necessary pressure to the fitment over the carton opening through a compression spring actuator 158. For hot-melt adhesives, an anvil head temperature of 93 to 138 degrees Centigrade, a pressure of 0.1790 to 0.447 kg/sq-cm., and a heating duration of 0.2 second have been found to produce excellent results. Variations of the heat, duration, and pressure will depend on the type and thickness of fitment material, the type of adhesive, and the seal area.

Figure 4A:
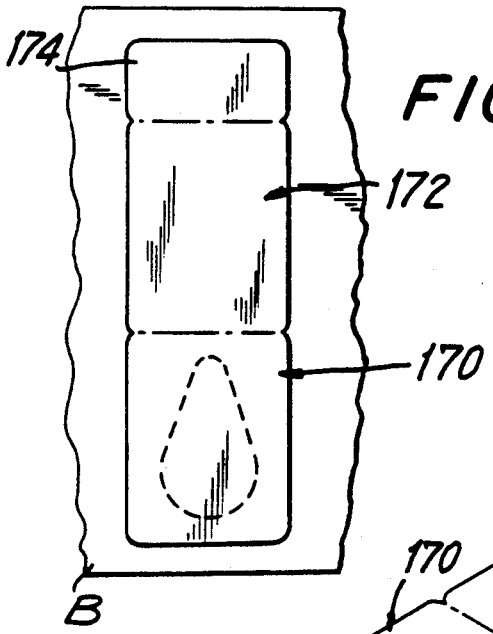
FIG. 4*a* is a top view.
Figure 4B:
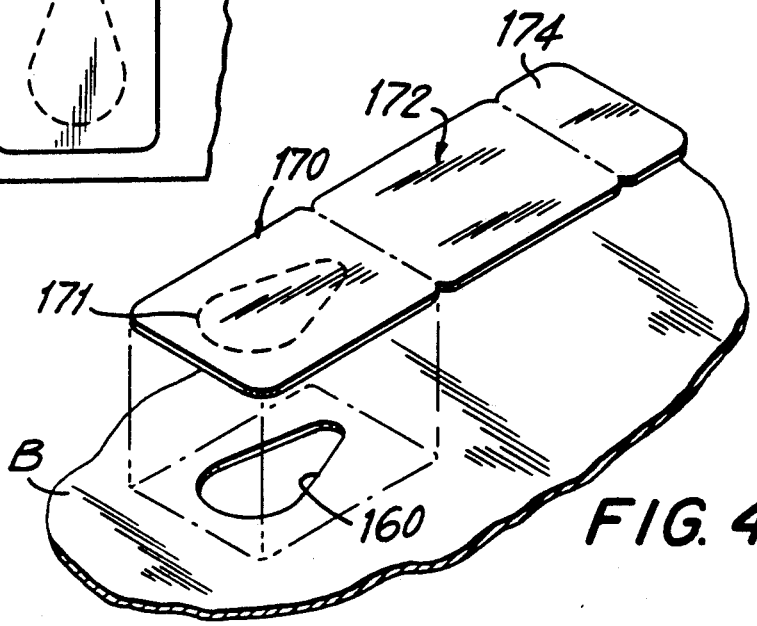
FIGS. 4*b*–4*d*, 4*f* and 4*g* are perspective views
Figure 4C:
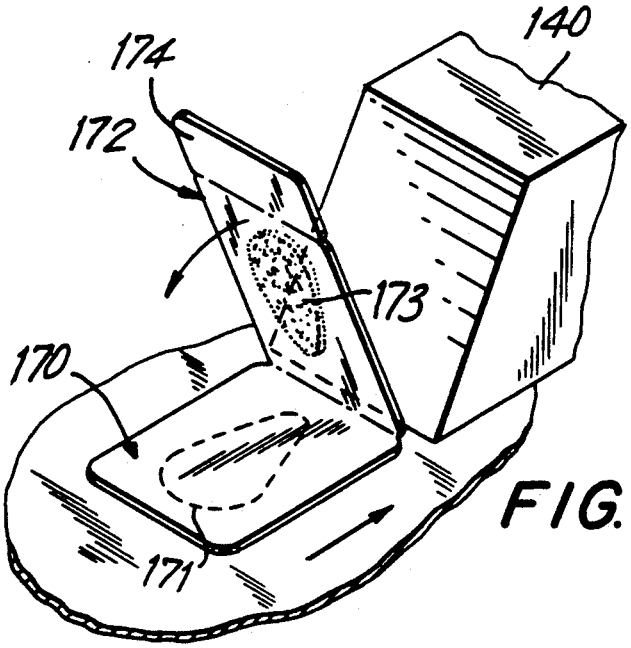
Figure 4D:
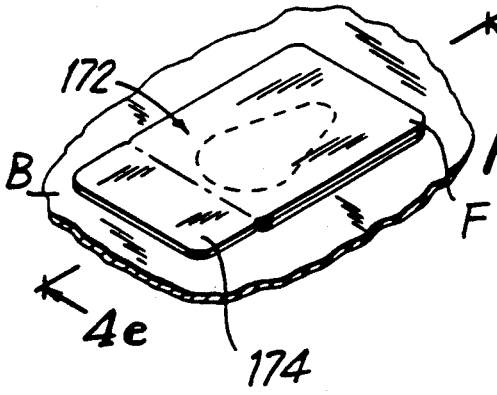
Figure 4E:
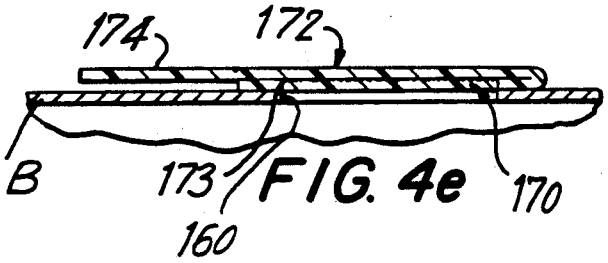
FIGS. 4*e*and 4*h* are sectional views (taken along the sections shown in FIGS. 4*d* and 4*g* respectively) showing the sealing of a teardrop fitment to a carton blank at various stages in the sealing process, and the manner of using the teardrop fitment.
Figure 4F:
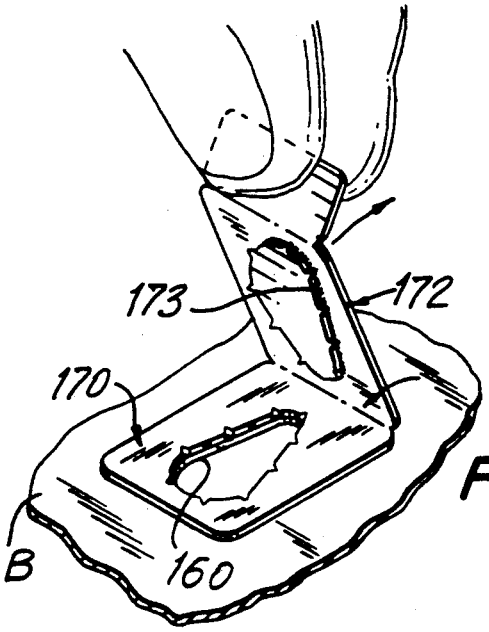
Figure 4G:
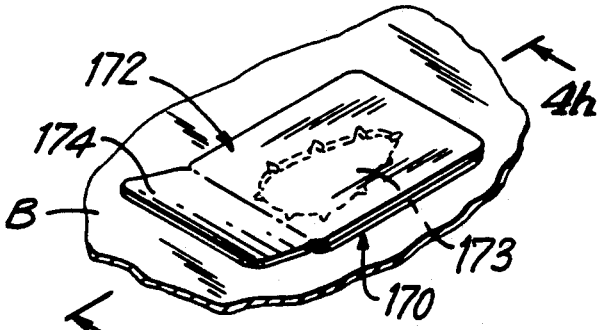
Figure 4H:
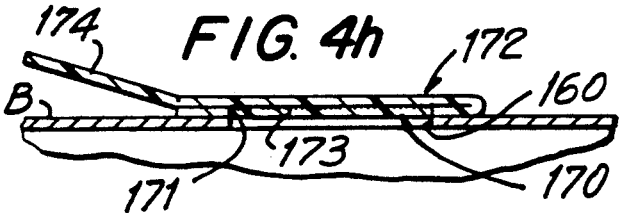

One preferred type of fitment for drink containers is the recloseable teardrop closure. As shown in more detail in FIGS. **4*a*–4*b*, the fitment F is comprised of three portions: a flange portion 170 which is sealed over a teardrop-shaped container opening 160 and has a corresponding teardrop hole 171 formed therein; a closure flap 172 which is hinged to the flange portion; and a lift-up tab 174. The flange portion 170 is adhered to the carton blank B in the attachment area around the hole 160. The flap portion 172 is folded over, as shown in FIGS. 4*c* and 4*d*, and adhered to any underlying seal or substrate layer by a teardrop-shaped spot of adhesive indicated by reference numeral 173. To open the spout, the tab 174 is lifted, and the flap 172 is separated from the flange portion 170. The teardrop-shaped spot of adhesive ruptures any underlying seal or substrate layer over the spout hole to allow access to the contents of the carton. The closure flap 172 may be reclosed by pressing it downward, guided by entry of the adhesive spot and any attached seal or substrate layer into the hole 171** in the flange portion.

To accommodate this type of three-part reclosable closure fitment, the system 100 can include an adhesive applicator 141, for applying the teardrop-shaped spot of adhesive 173 to the flap portion 172, and a fitment plowover bar 140, for folding the flap portion 172 of the fitment F back upon the flange portion of the fitment to cover and engage the spout-hole area, as shown between the fitment dispenser 125 and pre-treatment roller 130 in FIG. 2.

The invention thus provides a fitment sealing apparatus which is capable of high-speed continuous operation without the need to index or remove the carton blanks from a conveyor line. The apparatus can be operated at speeds which can match those of conventional form-/fill/seal lines, thereby allowing integration with existing types of lines. The rotary sealing member provides for uniform application of heat and pressure to the fitment over an extended duration as the carton blank moves along the conveyor path. The high-speed fitment application system may be used for different types of fitments, including 3-D embossed fitments, flat, teardrop-shaped fitments, low-profile embossed fitments (round opening), injection molded fitments, and thermo-formed fitments. The apparatus provides for positive control of the fitment application process to ensure accurate and precise positioning of the fitment relative to the carton blank, and produces a fitment seal of high seal integrity and reliability.

It will be recognized that numerous modifications are possible in light of the above disclosure. For example, many variations may be made to the arrangement of the flight conveyor, head pressure, temperature, and duration of sealing, as well as the rotation angle and heating duration, and other operating parameters. Similarly, the fitments and blanks illustrated for the described apparatus are merely exemplary of a diversity of fitments and blanks which may be employed, all of which can be accomodated within the principles of the present invention. Accordingly, it is intended that all such variations and modifications be nevertheless included within the scope and spirit of the invention as defined in the appended claims.

I claim:

1. An apparatus for synchronized high-speed sealing of fitments to carton blanks, each carton blank having an attachment area to which a fitment is assembled in predefined relation with the carton blank, comprising:

a first conveyor means for conveying a carton blank in a straight line along a first direction, said carton blank being disposed flat atop said first conveyor means and being carried thereby from a first position to a second position;

a second conveyor means for conveying said carton blank in a straight line along a second direction, said straight lines along said first and second directions being co-planar and non-parallel, said carton blank being disposed flat atop said second conveyor means and being carried thereby from a third position to a fourth position; and a rotary sealer having an axis of rotation substantially perpendicular to a plane containing said straight lines along said first and second directions and comprising a first sealing member which engages an assembly of a fitment on an attachment area of said carton blank at said second and third positions when said first sealing member is at first and second angular positions respectively and applies heat and pressure thereto over a prescribed turning angle during rotation of said first sealing member from said first angular position to said second angular position in order to ensure a fitment-to-carton seal.

2. An apparatus as set forth in claim 1, wherein said first sealing member has a tangential speed at said second position which is substantially equal to the speed of said first conveyor means.

3. An apparatus as set forth in claim 1, wherein said first and second conveyor means are arranged at substantially a right angle.

4. An apparatus as set forth in claim 3, wherein the rotary sealer supplies substantially uniform heat and pressure to the fitment/carton assembly through a turning angle of approximately 90 degrees.

5. An apparatus as set forth in claim 3, wherein the rotary sealer has four sealing members spaced circumferentially at 90 degrees from each other.

6. An apparatus in accordance with claim 1, further comprising applicator means arranged along said first conveyor means for applying a layer of hot-melt adhesive between the fitment and the attachment area of the carton blank, said hot-melt adhesive being softened by application of heat and pressure by said rotary sealer to form a seal between the fitment and carton.

7. An apparatus as set forth in claim 5, further comprising a fitment dispenser arranged along said first conveyor means for dispensing fitments of the flat, reclosable type having a flange portion with a teardrop-shaped opening therein which is adhered to the attachment area of the carton blank, and a flap portion which is folded over and adhered over said flange portion.

8. An apparatus as set forth in claim 7, further including a secondary adhesive applicator for applying a teardrop-shaped portion of adhesive on the flap portion of the fitment, and a plowover bar for folding over said flap portion and adhering it by said adhesive portion over said flange portion.

9. An apparatus as set forth in claim 1, wherein said rotary sealer further includes a compression spring actuator for applying a spring compression force to said first sealing member.

10. A fitment sealing system for synchronized high-speed sealing of fitments to carton blanks, each carton blank having an attachment area to which a fitment is assembled in predefined relation with the carton blank, comprising:

a first conveyor means for conveying a carton blank in a straight line along a first direction, said carton blank being disposed flat atop said first conveyor means and being carried thereby from a first position to a second position;

a second conveyor means for conveying said carton blank in a straight line along a second direction, said straight lines along said first and second directions being co-planar and non-parallel, said carton blank being disposed flat atop said second conveyor means and being carried thereby from a third position to a fourth position;

a carton supply station positioned at an entry end of said first conveyor means for placing said carton blank at said first position on said first conveyor means;

an adhesive applicator station arranged along said first conveyor means for applying a layer of hot-melt adhesive to the attachment area of said carton blank;

a fitment supply station arranged along said first conveyor means downstream of said adhesive applicator station for positioning a fitment on the adhesive layer of said carton attachment area; and a rotary sealer having an axis of rotation substantially perpendicular to a plane containing said straight lines along said first and second directions and comprising a first sealing member which engages an assembly of a fitment on an attachment area of said carton blank at said second and third positions when said first sealing member is at first and second angular positions respectively and applies heat and pressure thereto during rotation of said first sealing member from said first angular position to said second angular position in order to ensure a fitment-to-carton seal.

11. A system as set forth in claim 10, wherein said first sealing member has a tangential speed at said second position which is substantially equal to the speed of said first conveyor means.

12. A system as set forth in claim 10, wherein said first and second conveyor means are arranged at substantially a right angle.

13. A system as set forth in claim 10, wherein the rotary sealer supplies substantially uniform heat and pressure to the fitment/carton assembly through a turning angle of approximately 90 degrees.

14. A system as set forth in claim 10, wherein the rotary sealer has four sealing members spaced circumferentially at 90 degrees from each other.

15. A system as set forth in claim 10, wherein said fitment dispenser dispenses fitments of the flat, reclosable type having a flange portion with a teardrop-shaped opening therein which is adhered to the attachment area of the carton blank, and a flap portion which is folded over and adhered over said flange portion.

16. A system as set forth in claim 15, further including a secondary adhesive applicator for applying a teardrop-shaped portion of adhesive on the flap portion of the fitment, and a plowover bar for folding over said flap portion and adhering it by said adhesive portion over said flange portion.

17. A method for high-speed sealing of fitments to carton blanks, each carton blank having an attachment area to which a fitment is to be sealed, comprising the steps of:

conveying a carton blank from a first position to a second position in a straight line along a first direction;

conveying said carton blank from a third position to a fourth position in a straight line along a second direction, said straight lines along said first and second directions being co-planar and non-parallel; and arranging a rotary heat sealer to have an axis of rotation substantially perpendicular to a plane containing said straight lines along said first and second directions, said rotary sealer comprising a first sealing member which engages an assembly of a fitment on the attachment area of said carton blank at said second and third positions when said first sealing member is at first and second angular positions respectively and applies heat and pressure thereto over a prescribed turning angle during rotation of said first sealing member from said first angular position to said second angular position in order to form a seal between the fitment and the carton attachment area.

18. The method of claim 17 further comprising the step of applying a layer of hot-melt adhesive between the fitment and the carton attachment area, and applying the rotary sealer to soften the hot-melt adhesive layer to form a seal between the fitment and carton.

19. The method of claim 17 further comprising the step of controlling the speed of said first conveyor means and the rotational speed of the rotary sealer so that said first sealing member has a tangential speed at said second position which is substantially equal to the speed of said first conveyor means.

20. The method of claim 17 wherein the speeds of the conveyor means and rotary sealer are controlled to produce fitment-sealed carton blanks at a rate in the range of 300 blanks per minute or more.

* * * * *